US008024830B2

(12) United States Patent
Wang et al.

(10) Patent No.: US 8,024,830 B2
(45) Date of Patent: Sep. 27, 2011

(54) INFLATABLE BED HAVING A BUILT-IN ELECTRIC AIR PUMP UNIT FOR INFLATING A MATTRESS ASSEMBLY

(76) Inventors: Cheng-Chung Wang, Taipei (TW); Kenneth Wang, Taipei (TW)

( * ) Notice: Subject to any disclaimer, the term of this patent is extended or adjusted under 35 U.S.C. 154(b) by 0 days.

(21) Appl. No.: 11/937,663

(22) Filed: Nov. 9, 2007

(65) Prior Publication Data

US 2008/0109963 A1 May 15, 2008

(30) Foreign Application Priority Data

Nov. 10, 2006 (CN) ..... 2006 1 0148452

(51) Int. Cl.
*A47C 27/08* (2006.01)

(52) U.S. Cl. ..... 5/713; 5/706; 5/710; 417/201

(58) Field of Classification Search ... 5/713; 417/199.1, 417/201, 206, 362
See application file for complete search history.

(56) References Cited

U.S. PATENT DOCUMENTS

| | | | | |
|---|---|---|---|---|
| 3,394,415 | A * | 7/1968 | Parker | 5/713 |
| 5,509,154 | A * | 4/1996 | Shafer et al. | 5/713 |
| 5,606,756 | A * | 3/1997 | Price | 5/713 |
| 6,409,478 | B1 * | 6/2002 | Carnes et al. | 417/200 |
| 6,721,980 | B1 * | 4/2004 | Price et al. | 5/713 |
| 6,783,330 | B2 * | 8/2004 | Carnes et al. | 417/200 |
| 6,868,569 | B2 * | 3/2005 | VanSteenburg | 5/709 |
| 6,928,681 | B1 * | 8/2005 | Stacy | 5/713 |

* cited by examiner

*Primary Examiner* — Robert G Santos
*Assistant Examiner* — Nicholas Polito

(57) ABSTRACT

An inflatable bed includes a bedstead assembly, a mattress assembly having at least one air chamber, and an electric air pump unit disposed on the bedstead assembly. The air pump unit includes a centrifugal pump device for performing initial inflation of the air chamber, a diaphragm pump device for performing subsequent inflation of the air chamber, and a control valve operable to allow for and interrupt fluid communication between the centrifugal pump device and the air chamber.

13 Claims, 16 Drawing Sheets

INFLATABLE BED HAVING A BUILT-IN ELECTRIC AIR PUMP UNIT FOR INFLATING A MATTRESS ASSEMBLY

CROSS-REFERENCE TO RELATED APPLICATION

This application claims priority of Chinese Application No. 200610148452.X, filed on Nov. 10, 2006.

BACKGROUND OF THE INVENTION

1. Field of the Invention

This invention relates to an inflatable bed, and more particularly to an inflatable bed having a built-in electric air pump unit for inflating a mattress assembly.

2. Description of the Related Art

A conventional inflatable bed includes a built-in electric air pump for inflating a mattress of the inflatable bed. When the electric air pump is a centrifugal pump, although it can inflate the mattress at a higher speed, the air pressure in the mattress cannot be increased precisely to a desired pressure value. Conversely, when the electric air pump is a diaphragm pump, although it can inflate the mattress to increase precisely the air pressure in the mattress to the desired pressure value, the inflating speed thereof is slow.

SUMMARY OF THE INVENTION

The object of this invention is to provide an inflatable bed that includes an improved air pump unit, which can inflate a mattress at a high speed and which can increase precisely the air pressure in the mattress to a desired pressure value.

According to this invention, an inflatable bed includes a bedstead assembly, a mattress assembly having at least one air chamber, and an electric air pump unit disposed on the bedstead assembly. The air pump unit includes a centrifugal pump device for performing initial inflation of the air chamber, a diaphragm pump device for performing subsequent inflation of the air chamber, and a control valve operable to allow for and interrupt fluid communication between the centrifugal pump device and the air chamber.

To inflate the air chamber to a desired volume, the Centrifugal pump device may be first operated until the air chamber is expanded to about 90% of the desired volume at a higher speed. Subsequently, the diaphragm pump device is operated to inflate precisely the air chamber to the desired volume at a slower speed.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
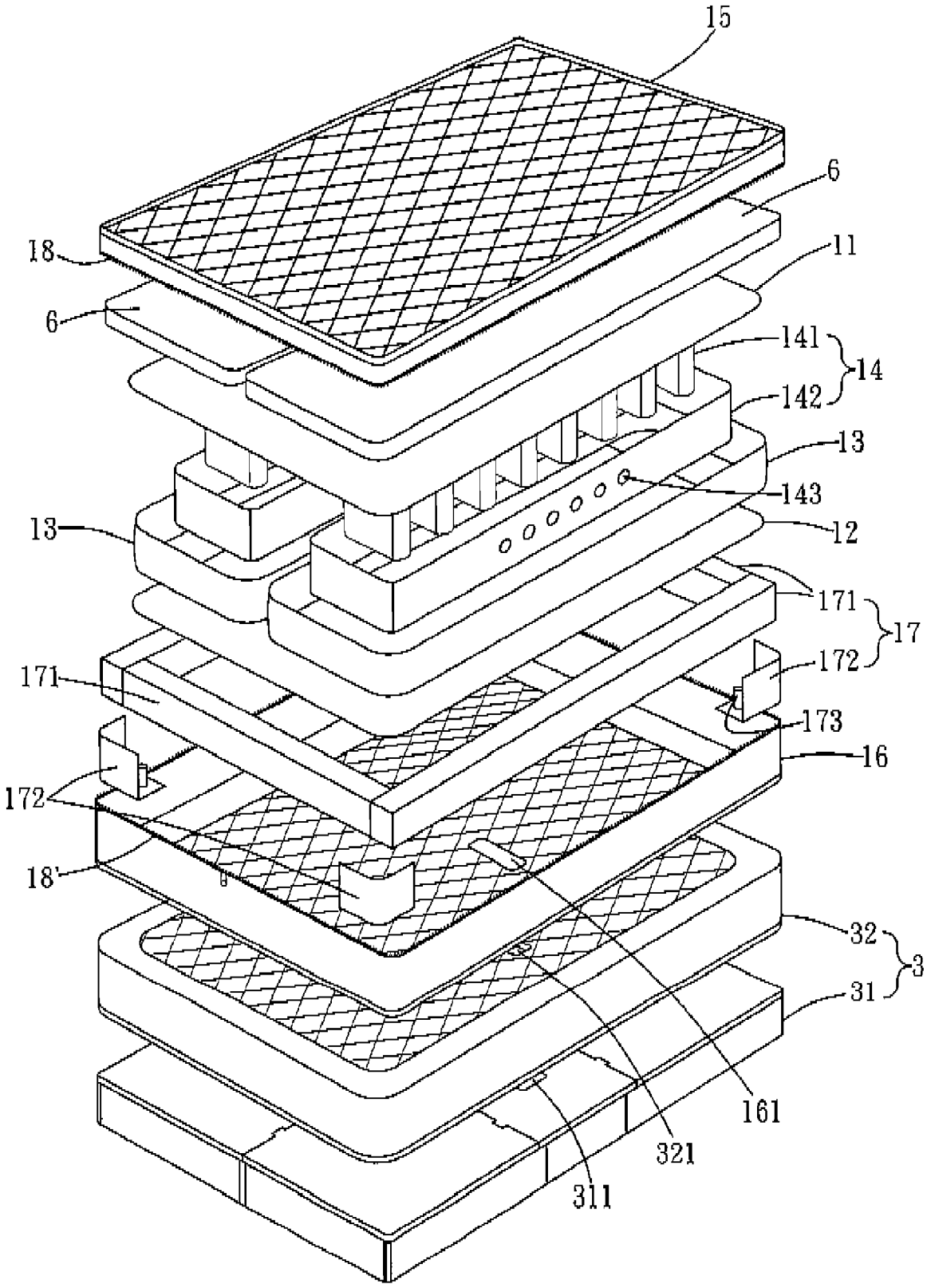
FIG. 1 is a fragmentary exploded perspective view of the first preferred embodiment of an inflatable bed according to this invention, wherein an electric air pump unit is removed.

Before the present invention is described in greater detail in connection with the preferred embodiments, it should be noted that similar elements and structures are designated by like reference numerals throughout the entire disclosure.

Figure 2:
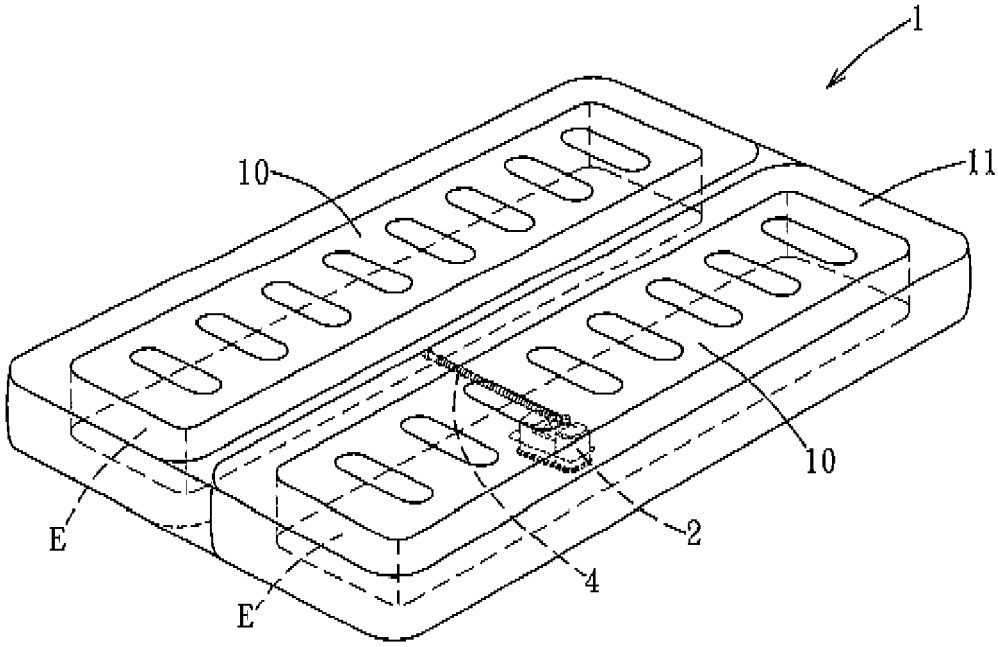
FIG. 2 is an assembled perspective view of a mattress assembly and the electric air pump unit of the first preferred embodiment.

Referring to FIGS. 1 and 2, the first preferred embodiment of an inflatable bed according to this invention includes a mattress assembly 1, a covering unit, an electric air pump unit 2, a bedstead assembly 3, and a cushion unit consisting of two cushion members 6.

Figure 1A:
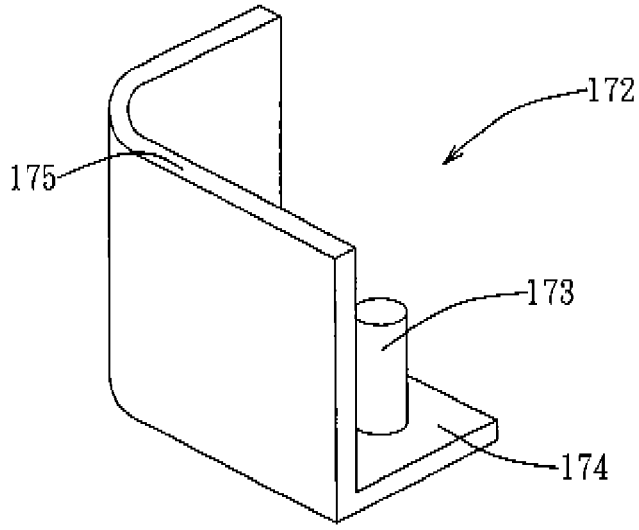
FIG. 1A is a perspective view of a corner positioning member of the first preferred embodiment.

The mattress assembly 1 includes a rectangular top sheet 11, a rectangular bottom sheet 12, two juxtaposed surrounding sheets 13 interconnecting the top and bottom sheets 11, 12 to define two air chambers (E) that are not in fluid communication with each other, and two reinforcing units 14 disposed respectively within the air chambers (E). When inflated fully, the air chambers (E) have the same shape and volume. As such, the mattress assembly 1 has two mattresses 10 each including a respective one of the surrounding sheets 13 and defining a respective one of the air chambers (E). Each of the mattresses 10 may be used to support one person. Each of the air chambers (E) is defined among the top and bottom sheets 11, 12 and the corresponding surrounding sheet 13. Each of the reinforcing units 14 includes a row of pull belts 141 and a surrounding belt 142 disposed around the row of pull belts 141 and formed with a plurality of vent holes 143 therethrough. Each of the pull belts 141 and the surrounding belts 142 is connected fixedly to the top and bottom sheets 11, 12. The top and bottom sheets 11, 12, the surrounding sheets 13, and the reinforcing units 14 are received within the covering unit. The covering unit includes an upper covering member 15, a lower covering member 16, and a surrounding member 17. The upper and lower covering members 15, 16 are interconnected by a zipper unit. The zipper unit consists of upper and lower zipper halves 18, 18' attached respectively to the upper and lower covering members 15, 16 and interconnected removably. The cushion members 6 are disposed between the upper covering member 15 and the top sheet 11. The bedstead assembly 3 includes a rectangular bedstead body 31 and a cover 32 for covering the bedstead body 31. The surrounding member 17 includes four sponge bars 171 arranged to form a rectangular frame disposed in the covering unit between the upper and lower covering members 15, 16, and four corner positioning members 172 (only three are shown in FIG. 1) for supporting tour corners of the rectangular frame, respectively. Each of the corner positioning members 172 is disposed between the upper and lower coverings 15, 16, and is formed with an integral positioning post 173 inserted into a hole (not shown) in the corresponding sponge bar 171. With further reference to FIG. 1A, in this embodiment, each of the corner positioning members 172 has a horizontal rectangular bottom plate portion 174 and an L-shaped plate portion 175 extending upwardly from two adjacent sides of the bottom plate portion 174. Each of the positioning posts 173 extends upwardly from the bottom plate portion 174 of the corresponding corner positioning member 172. The lower covering member 16, the bedstead body 31, and the cover 32 have respectively aligned holes 161, 311, 321 formed therethrough. The electric air pump unit 2 is received within the holes 161, 311, 321 in the lower covering member 16, the bedstead body 31 and the cover 32, is disposed under and in fluid communication with one of the air chambers (E), and is in fluid communication with the other air chamber (E) via an air tube 4 (see FIG. 2).

Figure 3:
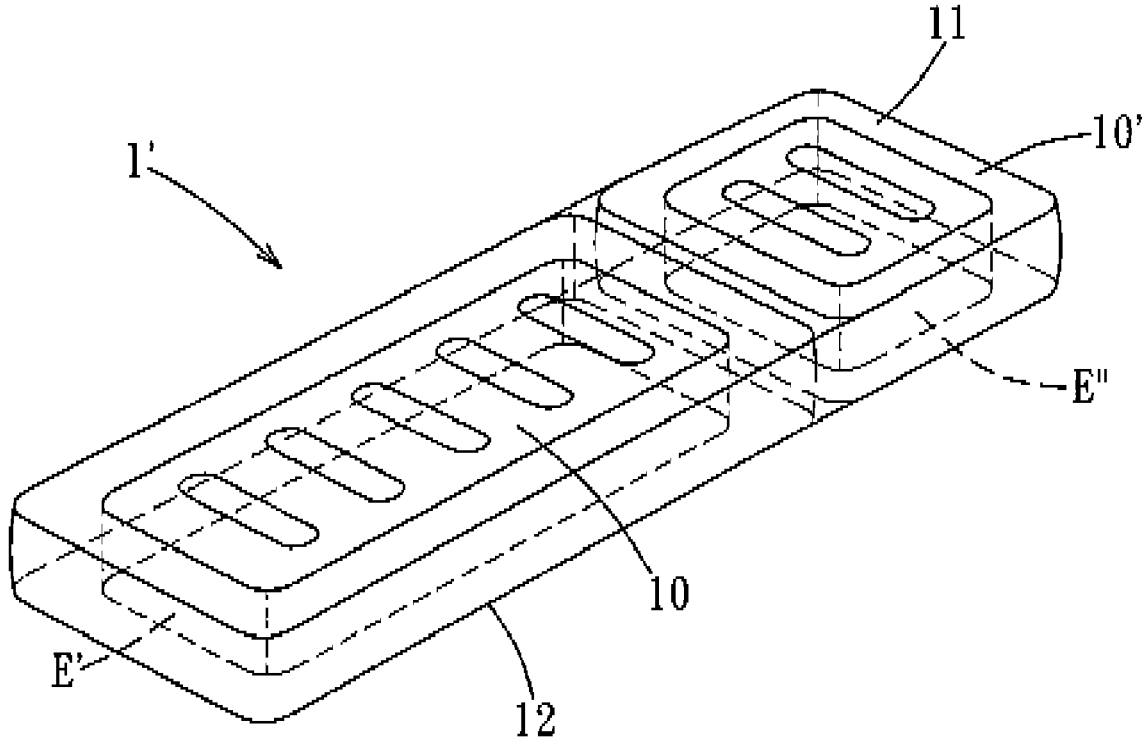
FIG. 3 is an assembled perspective view of a mattress assembly of the second preferred embodiment of an inflatable bed according to this invention.

Referring to FIG. 3, the second preferred embodiment of this invention is similar in construction to the first preferred embodiment. In this embodiment, a first modified mattress assembly 1' also includes a top sheet 11, a bottom sheet 12, two surrounding sheets (not shown), and two reinforcing units (not shown). The top and bottom sheets 11, 12 cooperate with the surrounding sheets to define a large air chamber (E') and a small air chamber (E") that are not in fluid communication with each other.

When inflated fully, the volume of the large air chamber (E') is greater than that of the small air chamber (E"). The reinforcing units are disposed respectively within the large and small air chambers (E', E"). The surrounding sheets are disposed respectively around the reinforcing units. As such, the mattress assembly 1' has a large mattress 10 and a small mattress 10'. Each of the large and small mattresses 10, 10' includes a respective one of the surrounding sheets, and defines a respective one of the large and small air chambers (E', E"). The large and small mattresses 10, 10' are used to support the body and head of one person, respectively.

Figure 4:
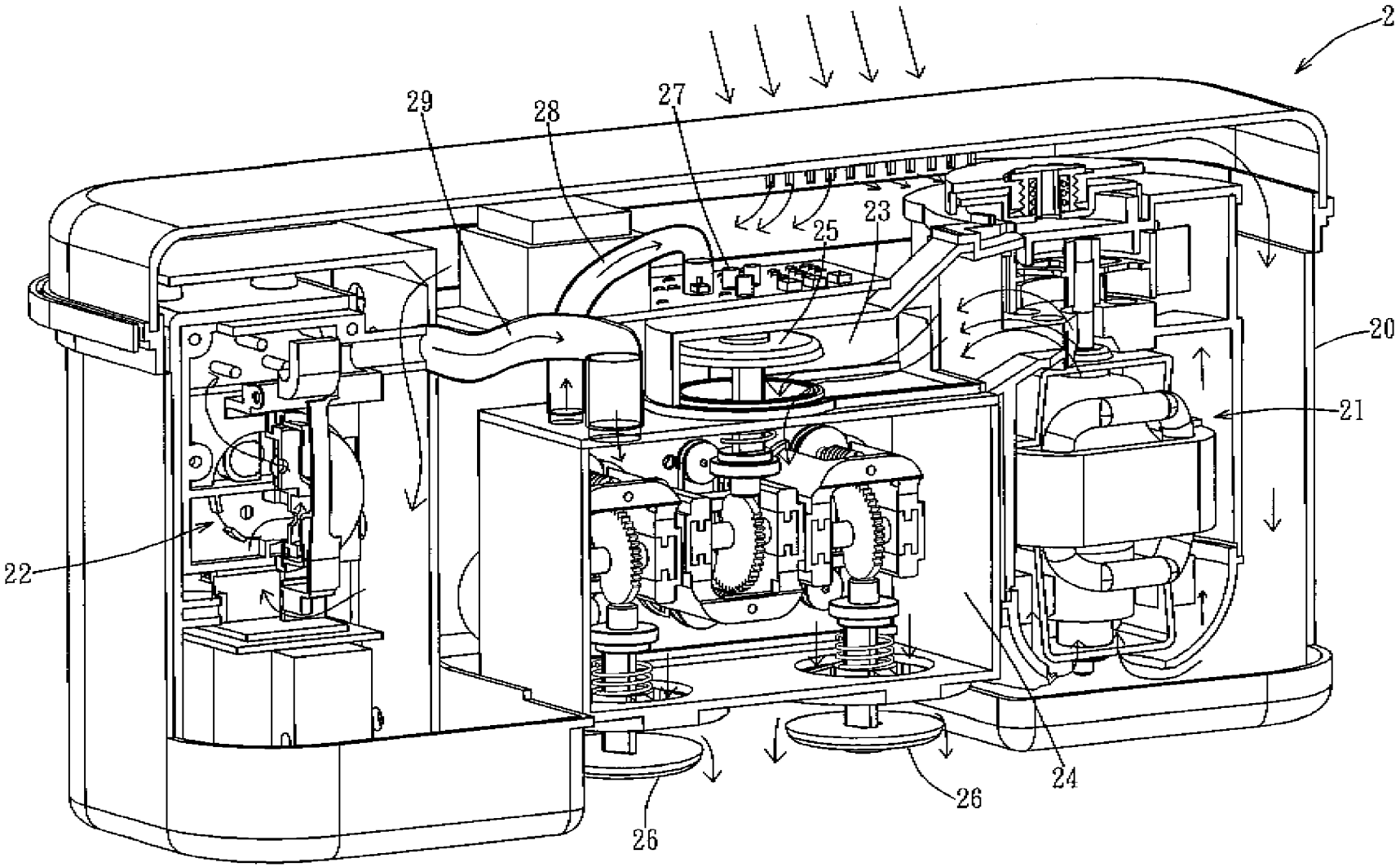
FIG. 4 is an assembled perspective view of an electric air pump unit of the first preferred embodiment.

With particular reference to FIG. 4, in this embodiment, the electric air pump unit 2 includes a housing 20, a centrifugal pump device 21 disposed in the housing 20, a solenoid-operated diaphragm pump device 22 disposed in the housing 20, a first transfer chamber 23 formed in the housing 20 and in fluid communication with the centrifugal pump device 21, a second transfer chamber 24 formed in the housing 20 and in fluid communication with the first transfer chamber 23, a first control valve 25 biased to a close position and operable to move to an open position so as to allow for fluid communication between the first and second transfer chambers 23, 24, two second control valves 26 each biased to a close position and operable to move to an open position so as to allow for fluid communication between the second transfer chamber 24 and a respective one of the large and small air chambers (E', E") in the mattress assembly 1', and a pressure sensor 27 in fluid communication with the second transfer chamber 24 via a sensor-connecting conduit 28.

It is noted that the centrifugal pump device 21 provides a smaller thrust for forcing air to flow at a higher flow rate, while the diaphragm pump device 22 provides a greater thrust for forcing air to flow at a slower flow rate. To promote the efficiency of the electric air pump unit 2 to inflate fully a selected one of the large and small air chambers (E', E"), the centrifugal pump device 21 is first operated until the selected one of the large and small air chambers (E', E") is expanded to about 90% of its full-inflated volume. Subsequently, the diaphragm pump device 22 is operated to inflate the selected one of the large and small air chambers (E', E") fully. That is, the centrifugal pump device 21 and the diaphragm pump device 22 perform respectively initial and subsequent inflation of the mattress assembly 1'. As a consequence, the air pump unit 2 can inflate the selected one of the large and small air chambers (E', E") at a high speed to increase precisely the air pressure in the same to a desired pressure value. Thus, the object of this invention can be achieved.

To inflate the selected one of the large and small air chambers (E', E"), the centrifugal pump device 21 is activated, and the first control valve 25 and the corresponding second control valve 26 are opened. Hence, air is drawn into the centrifugal pump device 21, and is then forced into the selected one of the large and small air chambers (E', E") via the first and second transfer chambers 23, 24. When the pressure sensor 27 detects that the air pressure in the second transfer chamber 24 reaches a first preset pressure value, e.g., 420 mmHG, it emits a signal to a controller 5 (see FIG. 7) via an electric wire 7 (see FIG. 7). When the controller 5 receives the signal, it deactivates the centrifugal pump device 21, closes the first control valve 25, and activates the diaphragm pump device 22 to force air into the second transfer chamber 24 via a pump-connecting conduit 29 until the pressure sensor 27 detects that the air pressure in the second transfer chamber 24 reaches a second preset pressure value to complete a full inflation of the selected one of the large and small air chambers (E', E").

Figure 5:
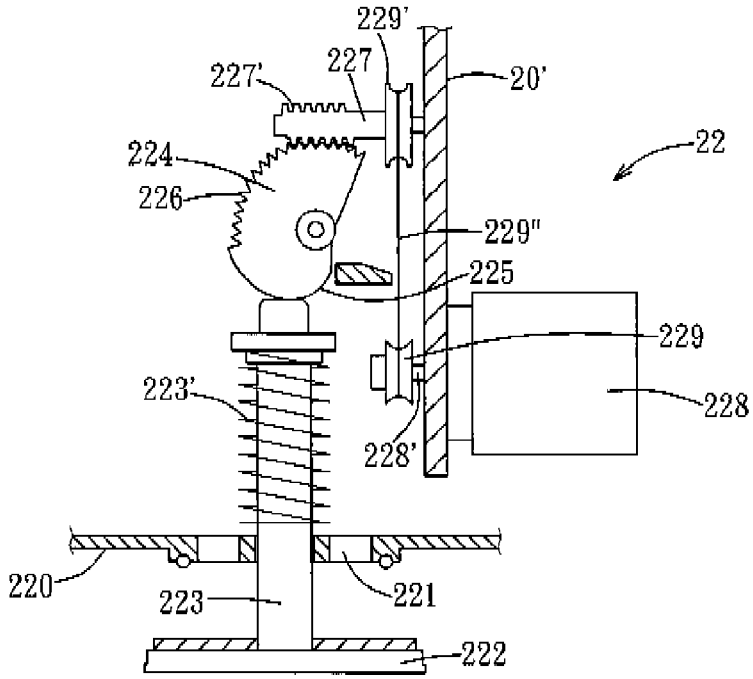
FIG. 5 is a partly sectional side view of a solenoid-operated diaphragm device of the electric air pump unit of the second preferred embodiment, illustrating a diaphragm valve in an opened state.
Figure 6:
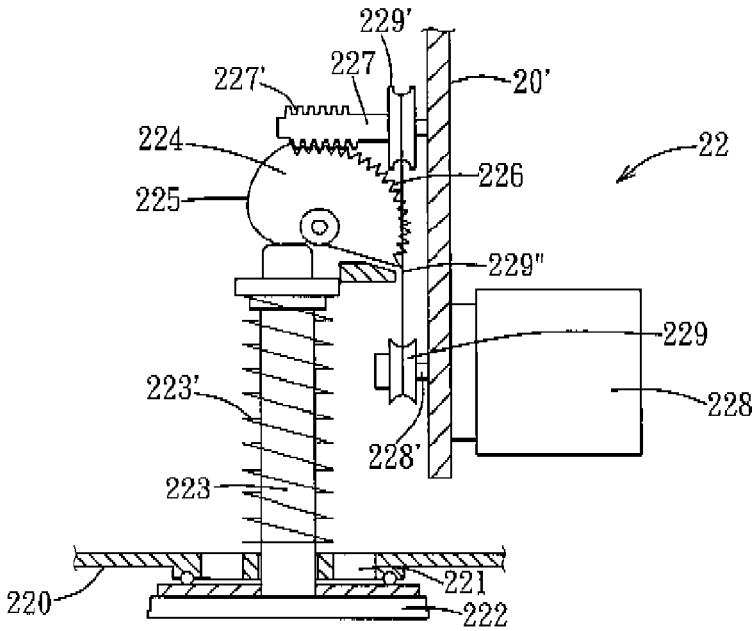
FIG. 6 is a view similar to FIG. 5 but illustrating the diaphragm valve in a closed state.

With further reference to FIGS. 5 and 6, the diaphragm pump device 22 includes a valve seat 220 formed with a valve hole 221, a diaphragm valve 222, a valve rod 223 connected fixedly to the diaphragm valve 222, a coiled compression spring 223' for biasing the diaphragm valve 222 to close the valve hole 221 in the valve seat 220, and a driving unit for moving the valve rod 223. The driving unit includes a cam member 224 pivotable relative to the valve seat 220 and having a cam surface 225 and a sector gear portion 226, a driving rod 227 rotatable about the central axis thereof and having a threaded portion 227' engaging the sector gear portion 226, a motor 228 having a motor shaft 2281, and a transmission unit 229 interconnecting the motor shaft 228' and the driving rod 227 for transferring rotation of the motor shaft 228' to the driving rod 227. An end of the valve rod 223 is biased by the compression spring 223' to contact the cam surface 225 of the cam member 224. The driving rod 227 and the motor shaft 228' are journalled on a mounting wall 20' of the housing 20. The transmission unit includes a driving pulley 229 sleeved fixedly on the motor shaft 228', a driven pulley 229' sleeved fixedly on the driving rod 227, and a transmission belt 229" trained on the driving pulley 229 and the driven pulley 229'.

Figure 7:
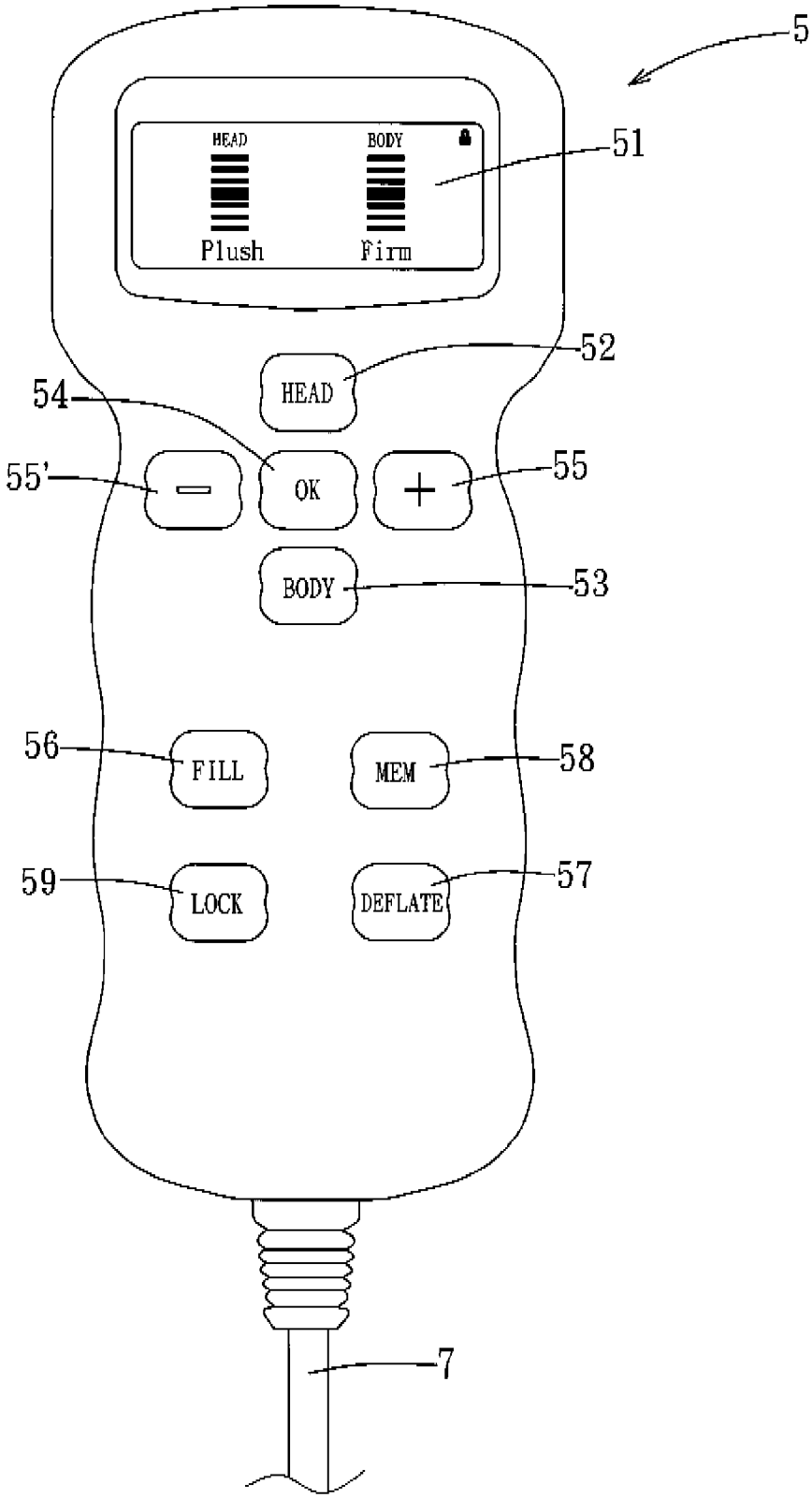
FIG. 7 is a schematic view of a controller of the second preferred embodiment.
Figure 8:
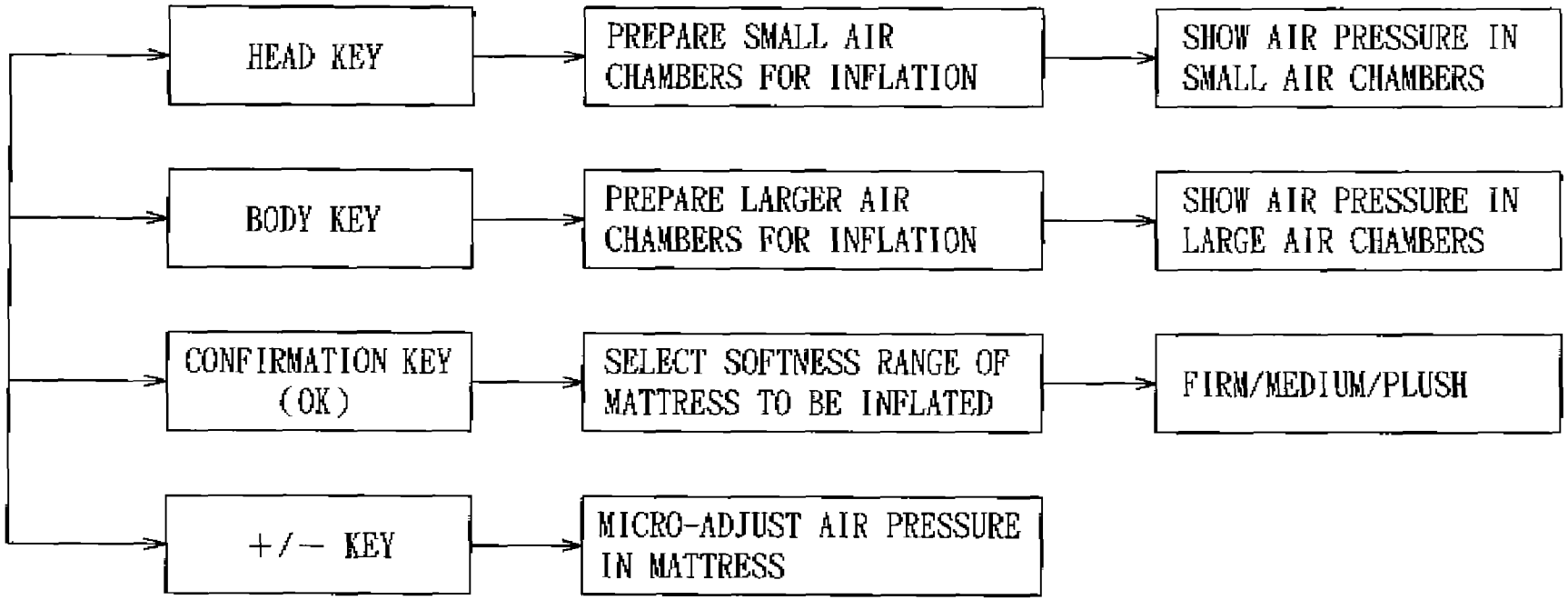
FIG. 8 is a flowchart illustrating operations of the second preferred embodiment in response to pressing of a head key, a body key, a confirmation key, a micro-adjustment inflation key, and a micro-adjustment deflation key, respectively.
Figure 9:
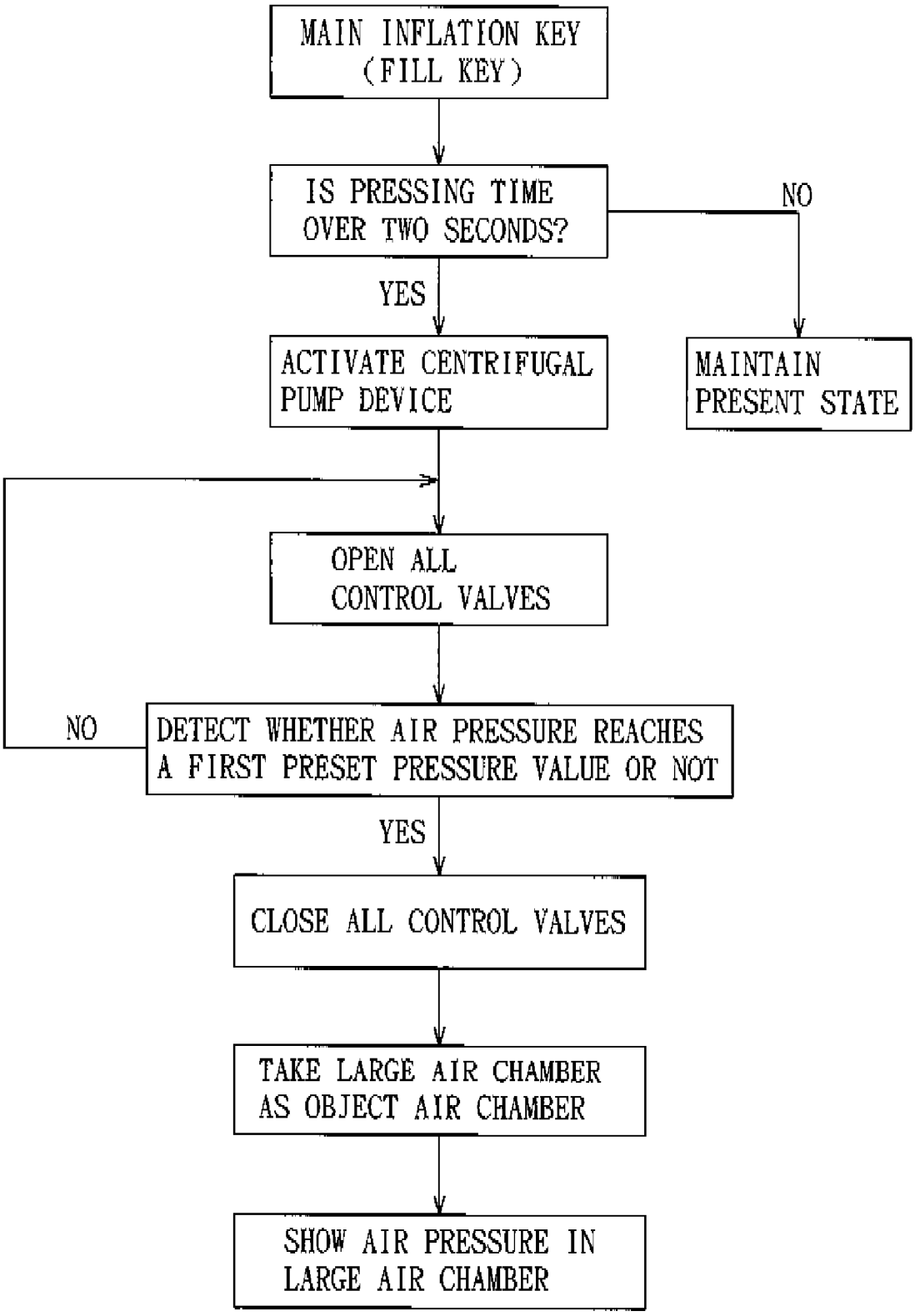
FIG. 9 is a flowchart illustrating operation of the second preferred embodiment in response to pressing of a main inflation key.
Figure 10:
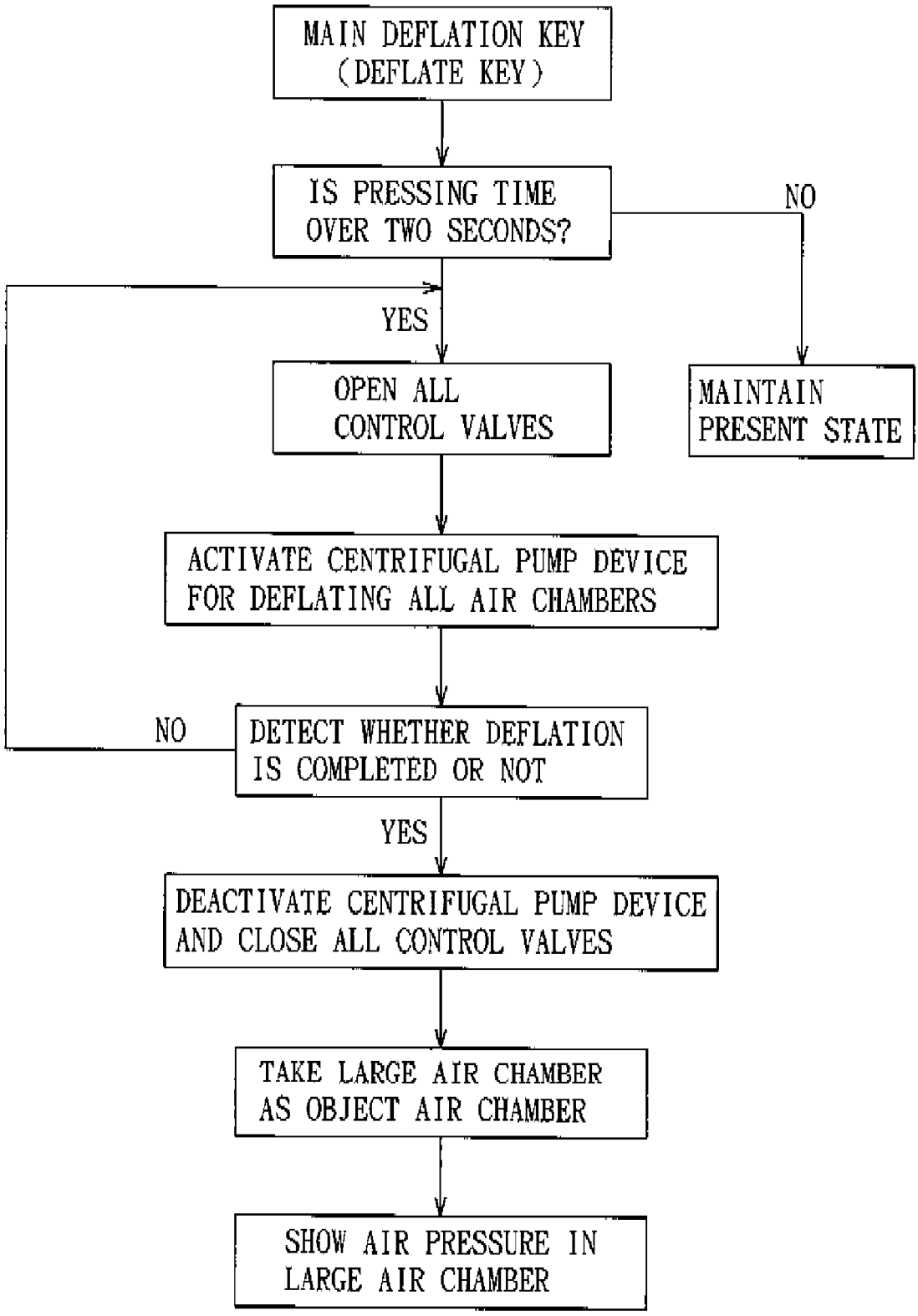
FIG. 10 is a flowchart illustrating operation of the second preferred embodiment in response to pressing of a deflation key.
Figure 11:
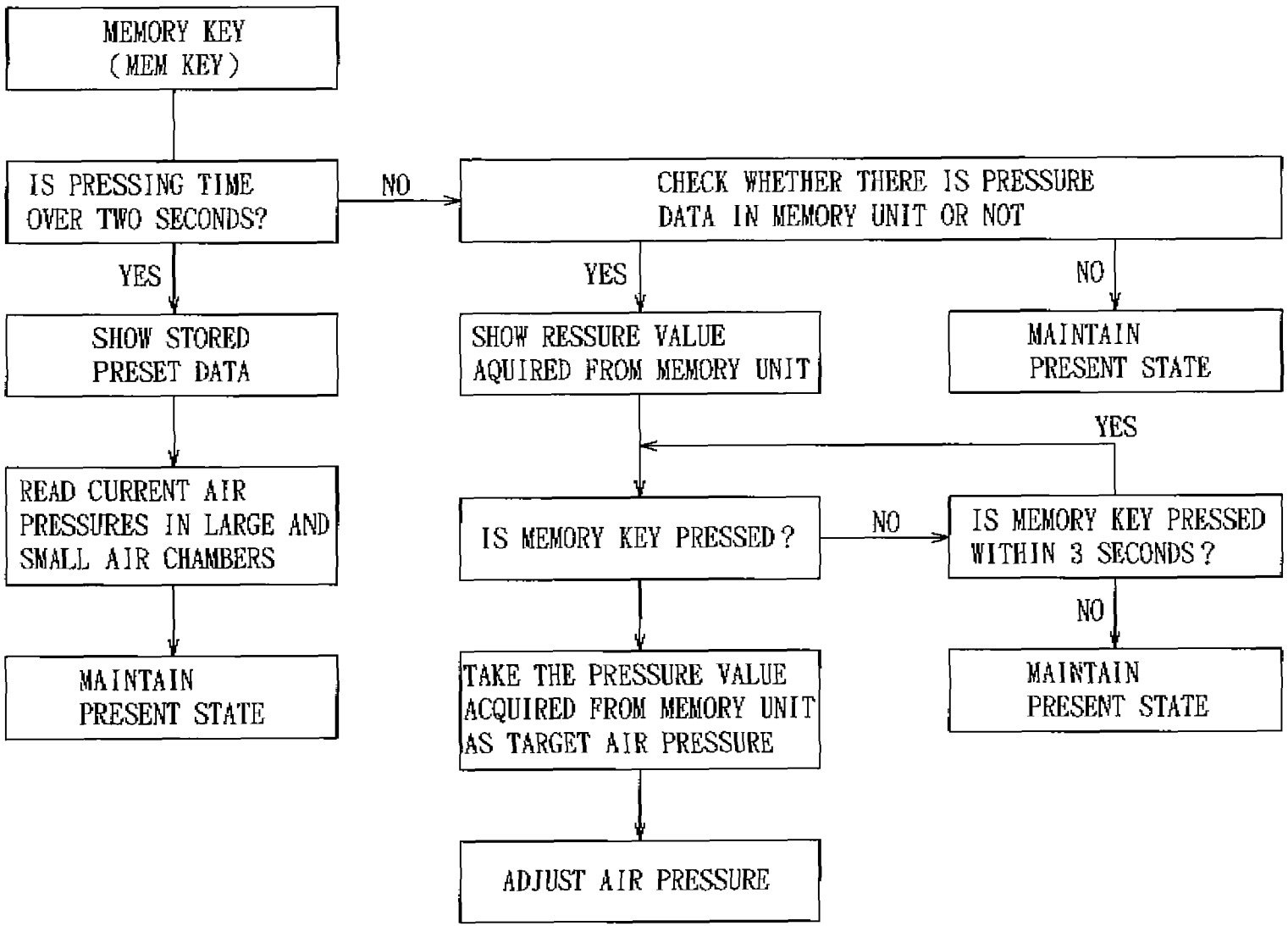
FIG. 11 is a flowchart illustrating operation of the second preferred embodiment in response to pressing of a memory key.
Figure 12:
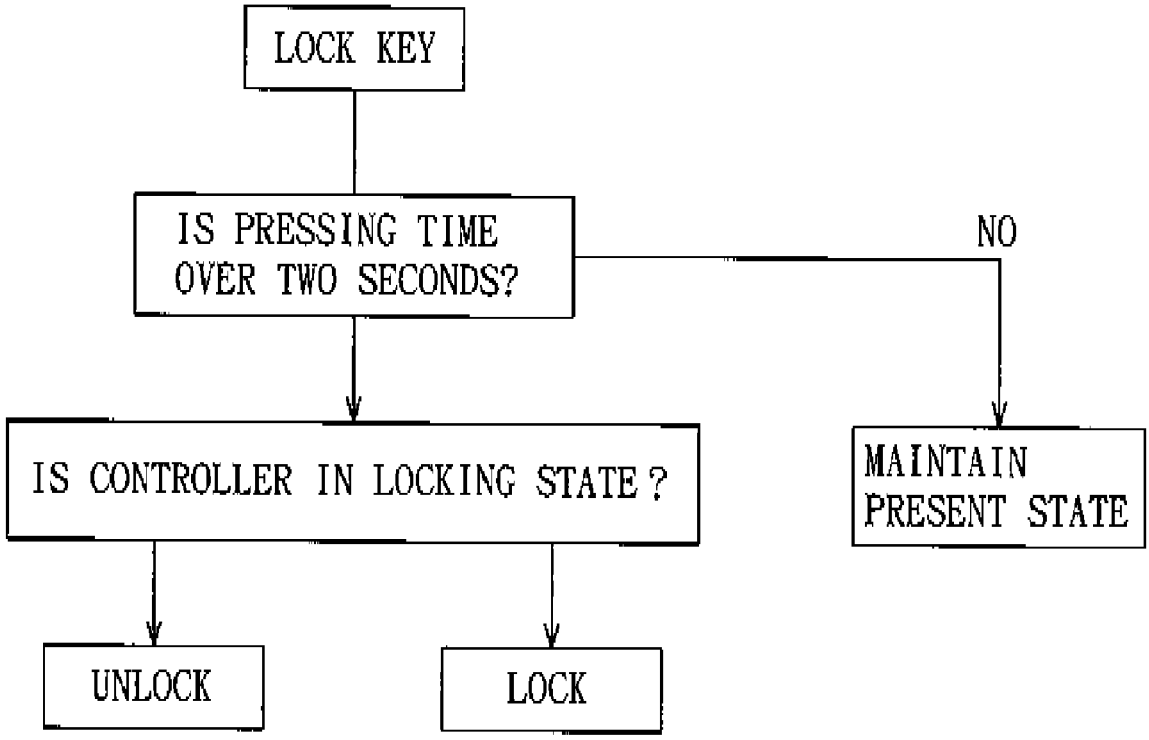
FIG. 12 is a flowchart illustrating operation of the second preferred embodiment in response to pressing of a lock key.

With further reference to FIG. 7, the controller 5 includes a display 51, a head key 52, a body key 53, a confirmation key 54, a micro-adjustment inflation key 55, a micro-adjustment deflation key 55', a main inflation key 56, a main deflation key 57, a memory key 58, and a lock key 59. The operations of the keys 52, 53, 54, 55, 55', 56, 57, 58, 59 are outlined in FIGS. 8, 9, 10, 11, and 12. The controller 5 is used to control the operation of the centrifugal pump device 21, the diaphragm pump device 22, and the first and second control valves 25, 26.

When it desired to inflate the mattress 1, the main inflation key 56 is first pressed to inflate the large and small air chambers (E', E") to the first preset pressure value through operation of the centrifugal pump device 21. Next, a selected one of the head key 52 and the body key 53 is pressed, and subsequently, the confirmation key 54 is operated to select the softness of the selected one of the large and small mattresses 10, 10'. During operation of the confirmation key 54, the word "FIRM" is shown in the display 51 when the confirmation key 54 is pressed for the first time, the word "MEDIUM" is shown in the display 51 when the confirmation key 54 is pressed for the second time, and the word "LUSH" is shown in the display 51 when the confirmation key 54 is pressed for the third time. Thereafter, if necessary, the micro-adjustment inflation key 55 or the micro-adjustment deflation key 55' can be pressed to micro-adjust the air pressure in the selected one of the large and small mattresses 10, 10' through operation of the diaphragm pump device 22. When "FIRM" is selected during operation of the confirmation key 54, the selected one of the large and small air chambers (E', E") can be inflated fully.

When it is desired to deflate a selected one of the large and small mattresses 10, 10', a corresponding one of the head key 52 and the body key 53 is pressed to open the first control valve 25 and the corresponding second control valve 26 to thereby allow air to flow from the selected one of the large and small mattresses 10, 10, out of the housing 20 via the first control valve 25 and the centrifugal pump device 21.

When it is desired to increase the softness of a selected one of the large and small mattresses 10, 10' the corresponding one of the head key 52 and the body key 53 is pressed, and the micro-adjustment deflation key 55' is operated. When the micro-adjustment deflation key 55' is pressed, the first control valve 25 and the corresponding second control valve 26 are opened to allow for outflow of air from the selected one of the large and small mattresses 10, 10'. When the micro-adjustment deflation key 55' is released, the first control valve 25 and the corresponding second control valve 26 are closed.

When it is desired to change the first preset pressure value, the memory key 58 is operated.

The control panel 5 can be converted between locked and unlocked states through pressing of the lock key 59. In the locked state, when any of the remaining keys 52, 53, 54, 55, 55', 56, 57, 58 is pressed (e.g., unintentionally), no operation is executed and the mattress assembly 1 remains in its present state.

Figure 13:
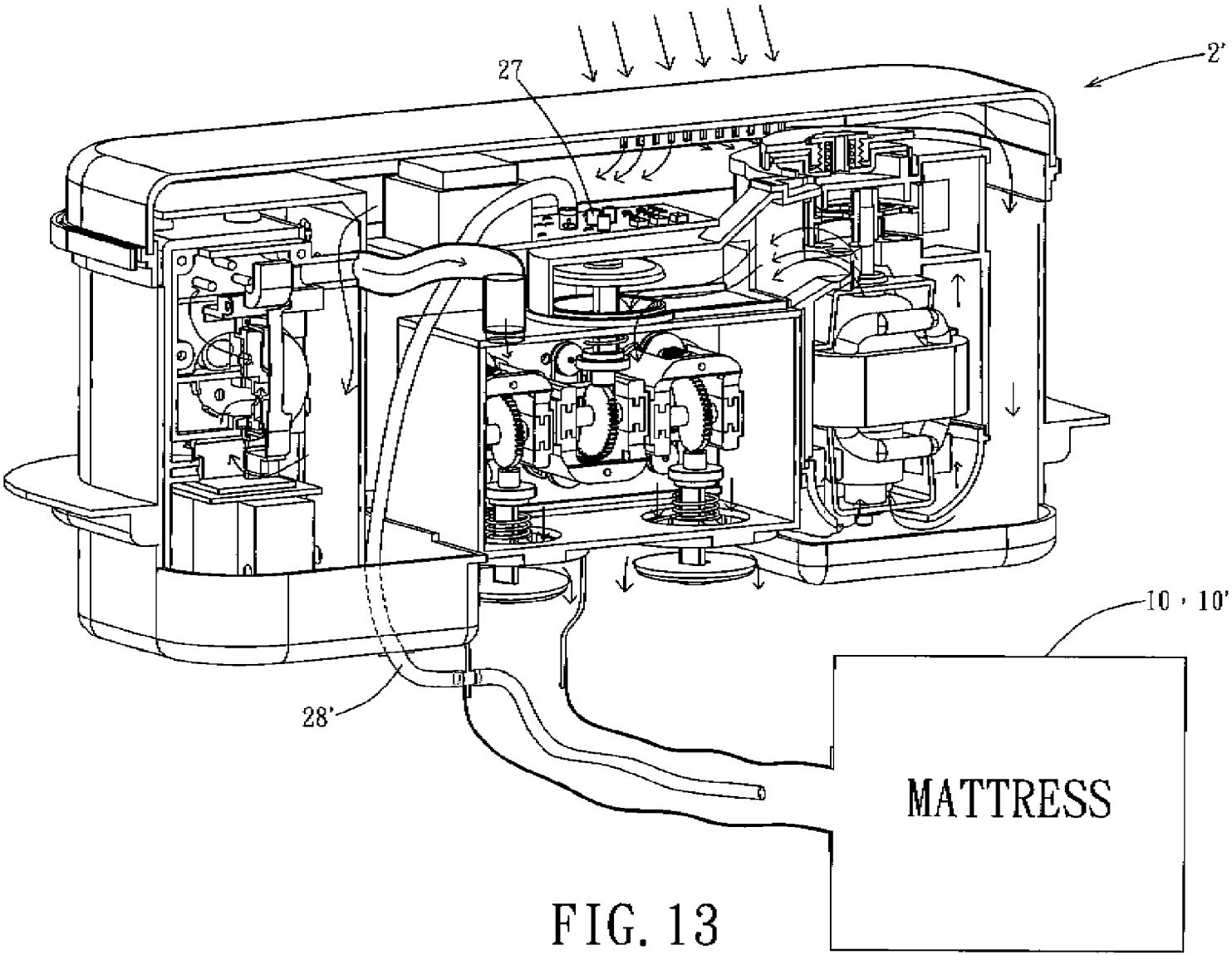
FIG. 13 is a schematic view illustrating a modified electric air pump unit.

FIG. 13 shows a modified air pump unit 2', which is similar in construction to the electric air pump unit 2 (see FIG. 4) except that the pressure sensor 27 is in fluid communication with the large and small mattresses 10, 10' through two mattress-connecting conduits 28' (only one is shown), respectively. As such, the air pressures in the large and small mattresses 10, 10' can be measured accurately.

Figure 14:
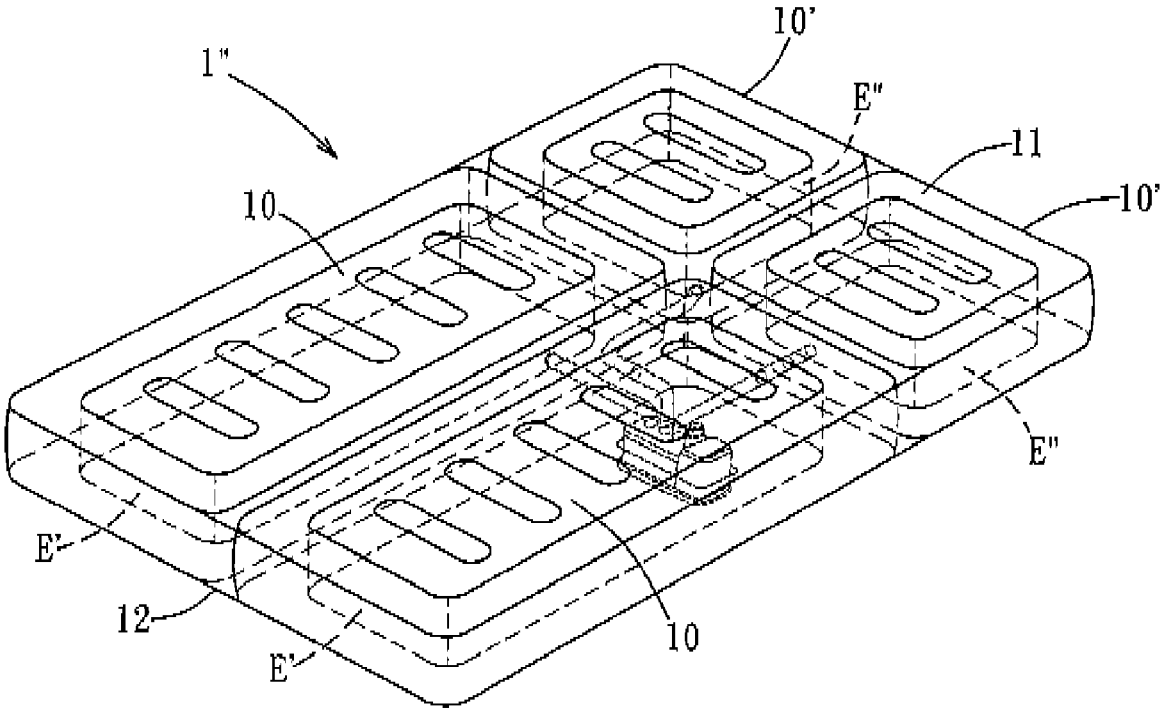
FIG. 14 is an assembled perspective view of a mattress assembly and an electric air pump unit of the third preferred embodiment of an inflatable bed according to this invention.

Referring to FIG. 14, the third preferred embodiment of this invention is similar in construction to the second preferred embodiment. In this embodiment, a second modified mattress assembly 1" includes four surrounding sheets (not shown) and four reinforcing units (not shown), and the control panel includes a pair of left and right head keys (not shown) for replacing the head key 52 (see FIG. 7), and a pair of left and right body keys (not shown) for replacing the body key 53 (see FIG. 7). The top and bottom sheets 11, 12 cooperate with the surrounding sheets to define two juxtaposed large air chambers (E') and two juxtaposed small air chambers (E"). The large and small air chambers (E',E") are arranged in a matrix. The reinforcing units are disposed respectively within the large and small air chambers (E', E"). The surrounding sheets are disposed respectively around the reinforcing units. As such, the mattress assembly 1" has two large mattresses 10 and two small mattresses 10'. Each of the large and small mattresses 10, 10' includes a respective one of the surrounding sheets, and defines a respective one of the large and small air chambers (E', E"). Each aligned pair of the large and small mattresses 10, 10' may be used to support the body and head of one person, respectively. Stated differently, the mattress assembly 1" can support two people.

Figure 15:
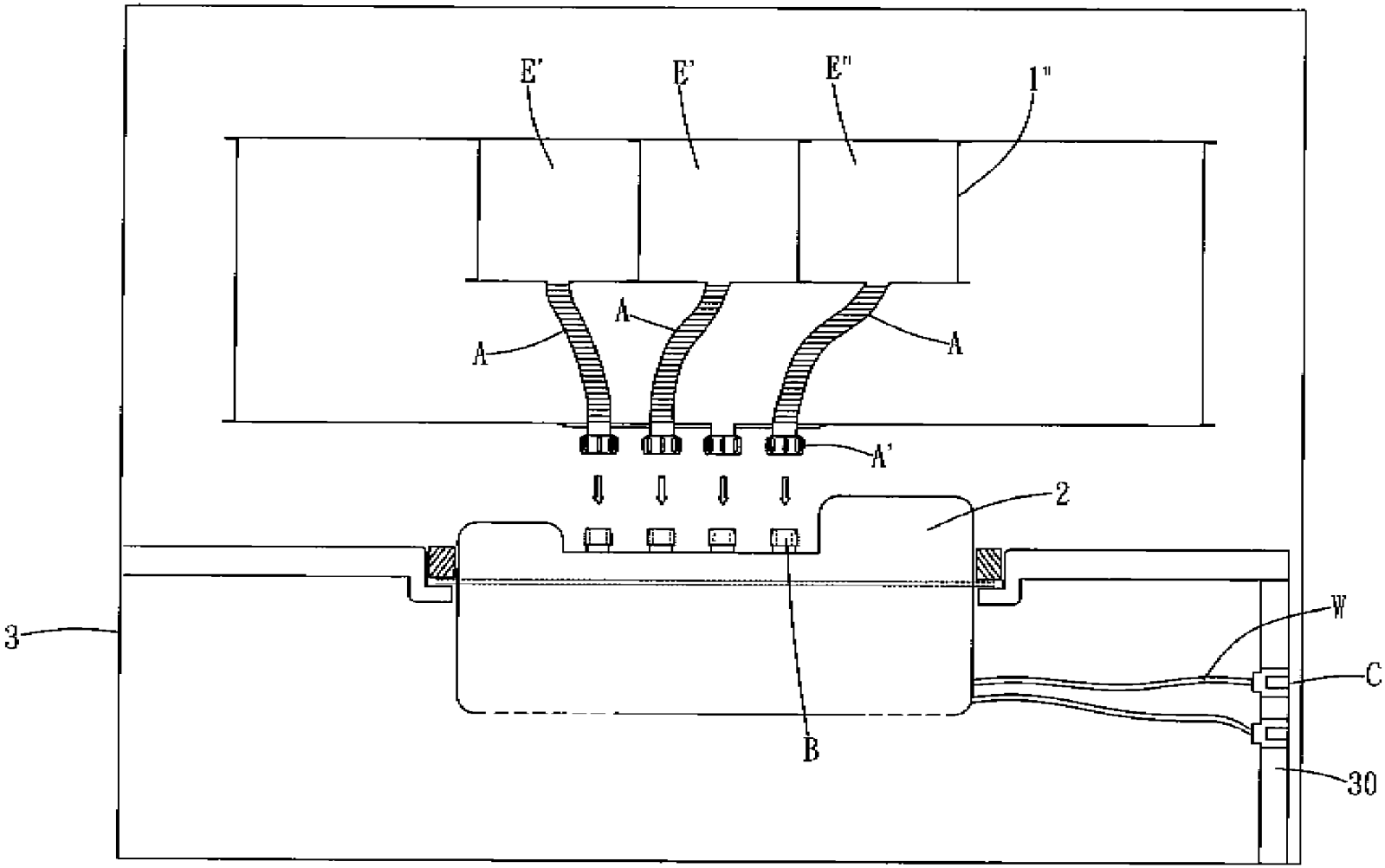
FIG. 15 is a schematic view illustrating a connection between the mattress assembly and an electric air pump unit of the third preferred embodiment.

In this embodiment, with additional reference to FIG. 15, the mattress assembly 1" includes four air conduits (A) (only three are shown) in fluid communication with the large and small air chambers (E', Err) (only three are shown), respectively. Each of the air conduits (A) has an internally threaded connecting end (A'). The electric air pump unit 2 includes four externally threaded connecting members (B) engaging respectively and threadably the connecting ends (A') of the air conduits (A) of the mattress assembly 1". An electric socket unit (C) is disposed on a sidewall 30 of the bedstead assembly 3. An electric wire unit (W) interconnects electrically the electric socket unit (C) and the electric air pump unit 2.

Figure 16:
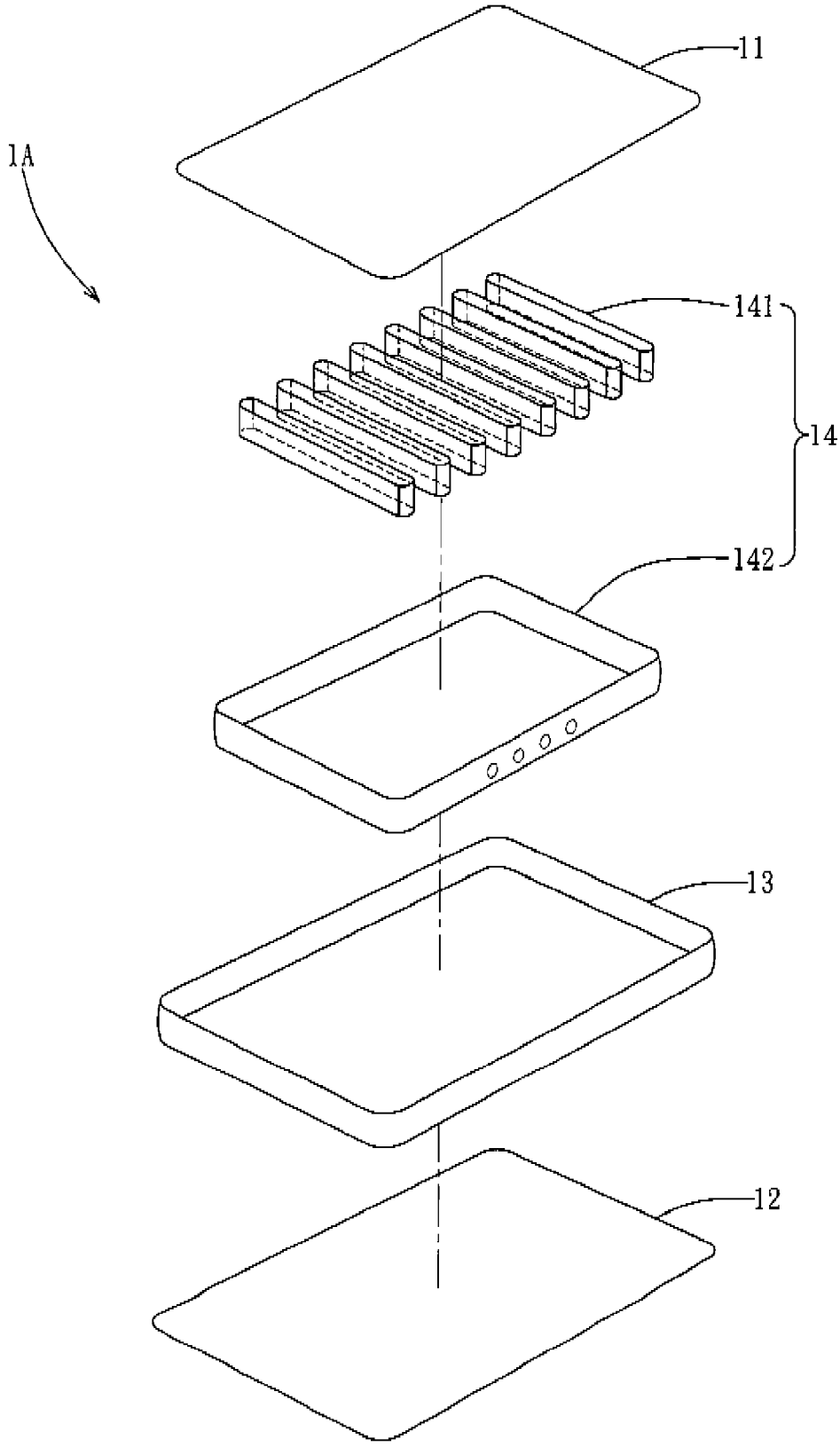
FIG. 16 is an exploded perspective view of a mattress assembly of the fourth preferred embodiment of an inflatable bed according to this invention.
Figure 17:
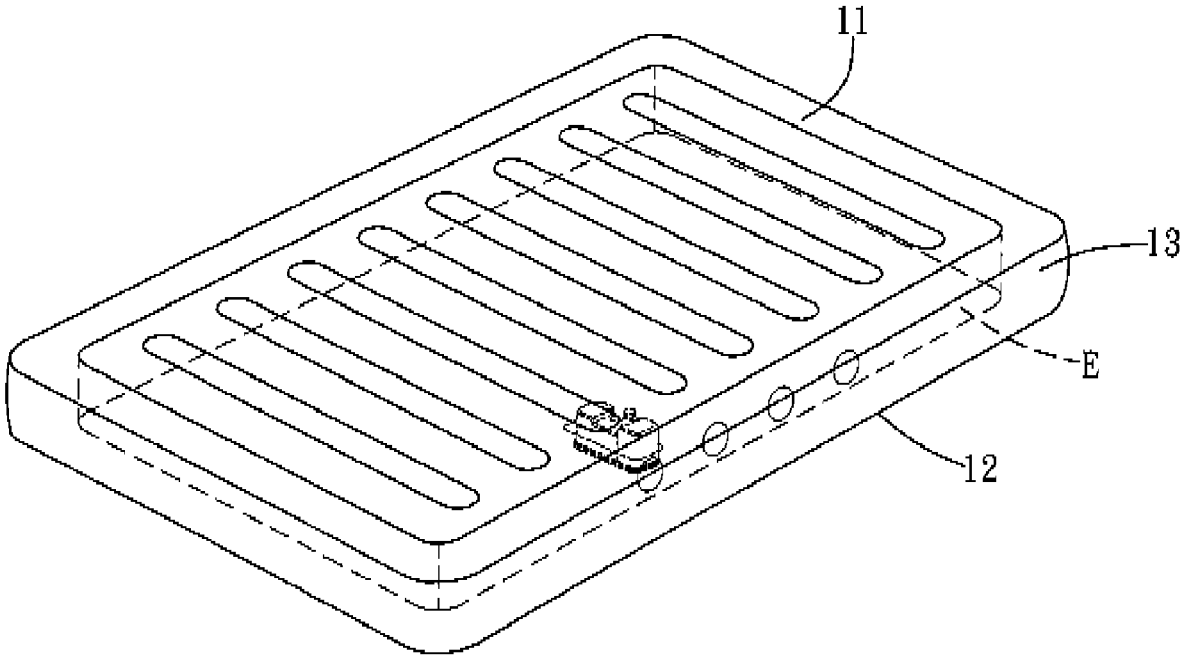
FIG. 17 is an assembled perspective view of the mattress assembly and an air pump unit of the fourth preferred embodiment.

Referring to FIGS. 16 and 17, the fourth preferred embodiment of this invention is similar in construction to the first preferred embodiment. In this embodiment, a third modified mattress assembly 1A includes a top sheet 11, a bottom sheet 12, a surrounding sheet 13 interconnecting the top and bottom sheets 11, 12 to define an air chamber (F), and a reinforcing unit 14 consisting of a plurality of pull belts 141 and a surrounding belt 142. In this embodiment, since the mattress assembly 1A is formed with a single air chamber (E), the second transfer chamber 24 (see FIG. 4) is in direct fluid communication with the air chamber (E), and the second control valves 26 are omitted from the configuration of the electric air pump unit 2.

To inflate the air chamber (E) to a desired volume, the centrifugal pump device 21 (see FIG. 4) may be first operated until the air chamber (E) is expanded to about 90% of the desired volume at a higher speed. Subsequently, the diaphragm pump device 22 (see FIG. 4) is operated to inflate precisely the air chamber (E) to the desired volume at a slower speed.

With this invention thus explained, it is apparent that numerous modifications and variations can be made without departing from the scope and spirit of this invention. It is therefore intended that this invention be limited only as indicated by the appended claims.

We claim:

1. An inflatable bed comprising:

a bedstead assembly;

a mattress assembly having at least one air chamber; and an electric air pump unit in connection with said mattress assembly and including:

a centrifugal pump device in fluid communication with said air chamber in said mattress assembly for inflating said air chamber, a first control valve operable to allow for and interrupt fluid communication between said centrifugal pump device and said air chamber, said first control valve being disposed between said centrifugal pump device and said air chamber, a diaphragm pump device in fluid communication with said air chamber fluidly separate from said first control valve for inflating said air chamber, an air pressure sensor in fluid communication with said air chamber, and a controller;

said controller being configured to control said first control valve to allow for flow of fluid from said centrifugal pump device into said air chamber therethrough so that said centrifugal pump device is operable to perform initial inflation of said air chamber to a first pressure value;

said air pressure sensor configured emit a signal indicating that the first pressure value has been reached; and said controller being configured to receive the signal from said air pressure sensor and accordingly control said first control valve to interrupt flow of fluid from said centrifugal pump device into said air chamber therethrough, deactivate the centrifugal pump, and activate the diaphragm pump so that said diaphragm pump device is operable to perform subsequent inflation of the air chamber from the first pressure value to a second pressure value.

2. The inflatable bed as claimed in claim 1, wherein said air pump unit further includes a housing for receiving said centrifugal pump device and said diaphragm pump device therein.

3. The inflatable bed as claimed in claim 2, wherein said mattress assembly is formed with two said air chambers that are not in fluid communication with each other; and said air pump unit further includes:

a first transfer chamber formed in said housing and in fluid communication with said centrifugal pump device;

a second transfer chamber formed in said housing and in fluid communication with said first transfer chamber and said air chamber, said first control valve being operable to allow for and interrupt fluid communication between said first and second transfer chambers; and two second control valves each controllable to allow for and interrupt fluid communication between said second transfer chamber and a respective one of said air chambers.

4. The inflatable bed as claimed in claim 3, wherein said controller is operable to control operation of said centrifugal pump device, said diaphragm pump device, and said first and second control valves.

5. The inflatable bed as claimed in claim 3, wherein said air pump unit further includes a sensor-connecting conduit, said air pressure sensor being in fluid communication with said second transfer chamber via said sensor-connecting conduit for detecting an air pressure in said second transfer chamber.

6. The inflatable bed as claimed in claim 1, wherein said air pump unit further includes at least one mattress-connecting conduit, said air pressure sensor being in fluid communication with said air chamber in said mattress assembly via said mattress-connecting conduit for detecting an air pressure in said air chamber.

7. The inflatable bed as claimed in claim 1, wherein said diaphragm pump device includes:

a valve seat formed with a valve hole;

a diaphragm valve;

a valve rod connected fixedly to said diaphragm valve; a coiled compression spring for biasing said diaphragm valve to close said valve hole in said valve seat; and a driving unit for moving said valve rod.

8. The inflatable bed as claimed in claim 7, wherein said driving unit includes:

a cam member pivotable relative to said valve seat and having a cam surface and a sector gear portion, an end of said valve rod being biased by said compression spring to contact said cam surface of said cam member;

a driving rod rotatable about a central axis thereof and having a threaded portion engaging said sector gear portion;

a motor having a motor shaft; and a transmission unit interconnecting said motor shaft and said driving rod for transferring rotation of said motor shaft to said driving rod.

9. The inflatable bed as claimed in claim 8, wherein said transmission unit includes:

a driving pulley sleeved fixedly on said motor shaft;

a driven pulley sleeved fixedly on said driving rod; and a transmission belt trained on said driving pulley and said driven pulley.

10. The inflatable bed as claimed in claim 1, wherein:

said mattress assembly includes a plurality of said air chambers, and a plurality of air conduits in fluid communication with said air chambers, respectively, each of said air conduits having a connecting end; and said electric air pump unit includes a plurality of connecting members engaging respectively and threadably said connecting ends of said air conduits of said mattress assembly.

11. The inflatable bed as claimed in claim 10, wherein said bedstead assembly includes a sidewall, said inflatable bed further comprising an electric socket unit disposed on said sidewall, and an electric wire unit interconnecting electrically said electric socket unit and said electric air pump unit.

12. The inflatable bed as claimed in claim 1, wherein said mattress assembly is disposed on and above said bedstead assembly.

13. The inflatable bed as claimed in claim 1, wherein said electric air pump unit is disposed on said bedstead assembly.

* * * * *